United States Patent [19]

Le Magourou

[11] Patent Number: 4,632,481

[45] Date of Patent: Dec. 30, 1986

[54] ELECTRICAL PRESSURE CONTACT

[75] Inventor: Yves Le Magourou, Ermont, France

[73] Assignee: Societe d'Exploitation des Procedes Marechal (SEPM), Paris, France

[21] Appl. No.: 732,294

[22] Filed: May 9, 1985

Related U.S. Application Data

[63] Continuation-in-part of Ser. No. 519,868, Aug. 3, 1983, Pat. No. 4,516,819, and a continuation-in-part of Ser. No. 722,916, Apr. 15, 1985, abandoned.

[30] Foreign Application Priority Data

Aug. 9, 1982 [FR] France ..... 82 13891
Mar. 21, 1985 [FR] France ..... 85 04198

[51] Int. Cl.[4] ..... H01R 13/635
[52] U.S. Cl. ..... 339/46; 339/111
[58] Field of Search ..... 200/51.09; 339/46, 75 R, 339/75 M, 111, 75 MP

[56] References Cited

U.S. PATENT DOCUMENTS 1,754,585 4/1930 Valkenburg ..... 200/70
3,370,141 2/1968 Garamszegi ..... 200/51.09

FOREIGN PATENT DOCUMENTS 0053194 6/1982 European Pat. Off. .
1242735 4/1965 Fed. Rep. of Germany .
2008420 9/1971 Fed. Rep. of Germany ..... 339/111
2030264 12/1971 Fed. Rep. of Germany ..... 339/111
1157309 5/1958 France .
356812 10/1961 Switzerland .
13455 of 1913 United Kingdom .
497810 12/1938 United Kingdom .

*Primary Examiner*—John McQuade
*Attorney, Agent, or Firm*—Sandler & Greenblum

[57] ABSTRACT

A pressure contact is capable of providing an electrical connection between a plug connector-pin and a stationary current-supply contact element placed within the internal chamber of a plug socket. A movable conductive member placed within the socket is adapted to be pushed upwardly by the connector-pin in opposition to a torsional spring located along a path which is parallel to the axis of the stationary contact element. The conductive member then moves clear of an end of the spring and moves upward abruptly, under the action of the torsional spring, until a contact element attached to the end of the movable member is applied against the stationary contact element in order to form an electrical connection.

23 Claims, 16 Drawing Figures

ELECTRICAL PRESSURE CONTACT

CONTINUING DATA

This is a continuation-in-part application of U.S. patent application Ser. No. 519,868, filed Aug. 3, 1983 now allowed, U.S. Pat. No. 4,516,819, hereby incorporated by reference thereto, and Ser. No. 722,916, filed Apr. 15, 1985 and now abandoned.

BACKGROUND OF THE INVENTION

1. Field of the Invention

The present invention generally relates to an electric pressure contact or connector and is more specifically directed to an electrical pressure contact having built-in opening and closing capability, i.e., a make-or-break connector or switch.

Contacts of this type can be employed in a variety of devices, e.g., modular systems, separable single-pull switches, and so on, but are particularly adapted for use as industrial current-supply connectors.

Industrial connectors must conform to regulations defined by Publication 309-I of the International Electrotechnical Commission (I.E.C.), and particularly that portion thereof which establishes the minimum breaking capacity for each size of connector.

2. Discussion of the Prior Art

In sliding contact connectors (contacts comprising connector-pins and sockets), the contact pressure exerted is perpendicular to the movement of withdrawal of the connector-pin and acts in opposition to such movement, which results in a breaking capacity which is practically nonexistent and which does not meet the regulations. In order to comply with the Commission's regulations as noted hereinabove, therefore, connectors of this type need to be locked by a switch.

In pressure-contact connectors, the contact pressure is exerted in a direction parallel to the movement of separation and assists the movement, thus requiring the provision of locking means for maintaining the desired contact pressure. It is then only necessary to add a suitable device to the locking means to ensure that the contact elements separate at a predetermined distance and speed at the moment of unlocking. In this fashion, the characteristics defined in Publication 309-I of the I.E.C. can thus be readily obtained. However, some countries, and most particularly the United States, require industrial current-supply connectors to have a contact breaking capacity which is comparable to that of a switch or, in other words, that they can achieve the performance specified for switches by Publication 408 of the I.E.C.

In end-pressure contacts of the type presently in use, current-supply connectors cannot satisfy this requirement because, when the connectors are unlocked and before the contact elements separate, the contact pressure, on the order of a few kilograms, steadily decreases and eventually falls to zero at the moment of separation. The speed of separation is additionally limited by the inertia of the system.

Two types of pressure contacts are presently utilized:

(a) for currents which are below 250 amps, pressure contacts are provided which include a resilient contact having a movable head mounted on a spring, the resilient contact being electrically connected to a stationary stud in order to connect the conductors via a braided wire element which is co-axial with the spring; and (b) for currents which are above 250 amps, pressure contacts are used which include a rocker-arm operating at right angles to a line of contact elements.

SUMMARY OF THE INVENTION

The present invention provides a third type of pressure contact and is capable of endowing the two above-noted pressure contacts with the breaking capacity of a switch by utilizing a rocker-arm which operates in a direction which is parallel to the line of the contact elements.

In comparison with contacts which utilize a braided wire element, a system of the present type offers all of the advantages of a rocker-arm contact. Specifically, these advantages include:

(a) the voltage drop of the device is guaranteed to be timely because, in contrast to braided wire element devices, variable voltage drops occur only at a contact point;

(b) the disadvantages inherent in brazing or crimping of braided wire elements are eliminated;

(c) the cross-section of the rocker-arm can be of a size which is at least equal to the largest conductor which it is possible to connect to the device; and (d) movement of the rocker-arm results in a powerful self-cleaning effect for the contacts of the system.

Further, in this design, each contact becomes a single-pulse switch having quick make and break-type action which is independent of the action produced by the switch operator.

In accordance with one aspect of the present invention, the pressure contact establishes an electrical connection between a conductive connector-pin, which is rigidly mounted on the insulating support of a plug, and a stationary contact element, which is electrically connected to an input terminal. The stationary contact element can comprise a semi-cylindrical contact bead or a flat contact plate. The stationary contact element is positioned within a chamber formed in the insulating support of the plug socket. The plug connector-pin is introduced axially into the plug socket chamber. The bodies of the plug and of the socket are adapted to carry associated guiding and locking means for initiating and maintaining mating action of the elements.

The pressure contact essentially comprises a rigid and movable conductive member positioned within the plug socket chamber. This conductive member is designed to pivot within the chamber under pressure exerted by the free end of the connector-pin. The pressure is applied against the conductive member in opposition to the bias of a resilient means which biases the conductive member towards a chamber bore through which the connector pin is inserted.

Guiding means are provided to ensure that the conductive member pivots about at least one axis in a direction which is substantially perpendicular to the longitudinal axis of the contact, until the end of the conductive member, which is remote from the heel and has mounted thereon a contact element, reaches the level of the stationary contact plate, which is connected to the input terminal. The contact element mounted on the conductive member can comprise a semi-cylindrical contact bead or a flat contact plate.

The conductive member, the guiding means and a retaining means are arranged so that, at the end of the pivoting motion, the conductive member escapes from the retaining means in order to be abruptly applied against the stationary contact plate under the action of the resilient means. The resilient means assists in abruptly opening the contact when the plug connector-pin is withdrawn by enhancing the tilting motion of the conductive member.

A veritable make and break switch is thus obtained which simultaneously causes high contact pressure and compliance with safety regulations because the stationary contact plate cannot be touched accidentally. It is thus impossible to gain access to the contact plate simply by thrusting back the conductive member.

According to one aspect of the invention, the pressure contact is adapted to establish an electrical connection between a movable conductive connector-pin rigidly attached to a support and a stationary contact element electrically connected to an input terminal and located within a plug socket chamber, when the connector-pin is axially introduced into the plug socket chamber. The support and the socket include means for guiding the connector-pin into the socket. The pressure contact comprises a rigid and movable conductive member located within the plug socket chamber. The conductive member pivots about at least one axis in response to continued axial movement of a free end of the connector-pin. The rigid connective member includes a heel having an exterior surface which is in contact with the free end of the connector-pin as it moves longitudinally through the chamber and the rigid conductive member has a contact element attached thereto. The pressure contact comprises means for guiding the conductive member as it moves through the chamber until the contact element mounted on the conductive member establishes sudden contact with the stationary contact element. The pressure contact also comprises resilient means for biasing the heel against the free end of the connector-pin as the connector-pin is introduced into the chamber.

According to another aspect of the invention, a pressure contact is provided for establishing an electrical connection comprising a stationary contact element electrically connected to an input terminal and located within a plug socket chamber. The pressure contact also comprises a movable conductive connector-pin rigidly attached to a support to be introduced into a bore in said chamber. The pressure contact further comprises an intermediate pivotable conductive member positioned between the stationary contact element and the bore, wherein the pivotable conductive member moves along a path parallel to the longitudinal axis of said stationary contact element in response to the introduction of the connector-pin into the bore, and simultaneously pivots about at least one axis that is perpendicular to the longitudinal axis of said stationary contact element such that an electrical connection is established between the stationary contact element and the conductive member.

In another aspect of the invention, a pressure contact is adapted to establish an electrical connection between a movable conductive connector-pin rigidly attached to a support and a stationary contact element electrically connected to an input terminal and located within a plug socket chamber, when the connector-pin is axially introduced into the plug socket chamber. The support and the socket include means for guiding the connector-pin into the socket. The pressure contact comprises a rigid and movable conductive member located within the plug socket chamber. The conductive member pivots about at least one axis in response to continued axial movement of a free end of the connector-pin. The pressure contact also comprises means for retaining the conductive member, and means for guiding the conductive member pivotally about said at least one axis until the conductive member escapes from the retaining means, wherein, upon the escape of the conductive member from the retaining means, the conductive member establishes sudden contact with the stationary contact element. The pressure contact also includes single resilient means for biasing the conductive member against the free end of the connector-pin as the connector-pin is introduced into the chamber.

In another aspect of the invention, a connector is provided for placing a plug and a socket into electrical engagement, the plug having a connector-pin and the socket having a chamber. The connector comprises a movable conductive member having a generally V-shape, including a first branch which comprises a heel which has an exterior surface which is in contact with a free end of the connector-pin as it moves longitudinally through the chamber. The conductive member includes a second branch which comprises an arm having an exterior surface, the exterior surface of the arm having a contact element attached thereto. The conductive member is positioned within the chamber. The conductive member pivots in at least one direction about at least one axis in response to the introduction of the connector-pin into the chamber and pivots in at least one direction about at least one axis in response to withdrawal of the connector-pin from the chamber. The connector also comprises a spring comprising a coil portion rotatably mounted about a support pin integrally connected to a wall of the chamber. The spring also comprises a first arm to the conductive member to form an axis of rotation and a second arm positioned in abutting relationship with a projection extending inwardly from the wall of the chamber. The connector also comprises means located within the chamber for guiding movement of the conductive member as it pivots and moves longitudinally within the chamber.

BRIEF DESCRIPTION OF THE DRAWINGS

Other features of the present invention will become more apparent to those of ordinary skill in the art to which this invention pertains upon further consideration of the following description and accompanying drawings, in which.

DETAILED DESCRIPTION OF THE DRAWINGS

Figure 1:
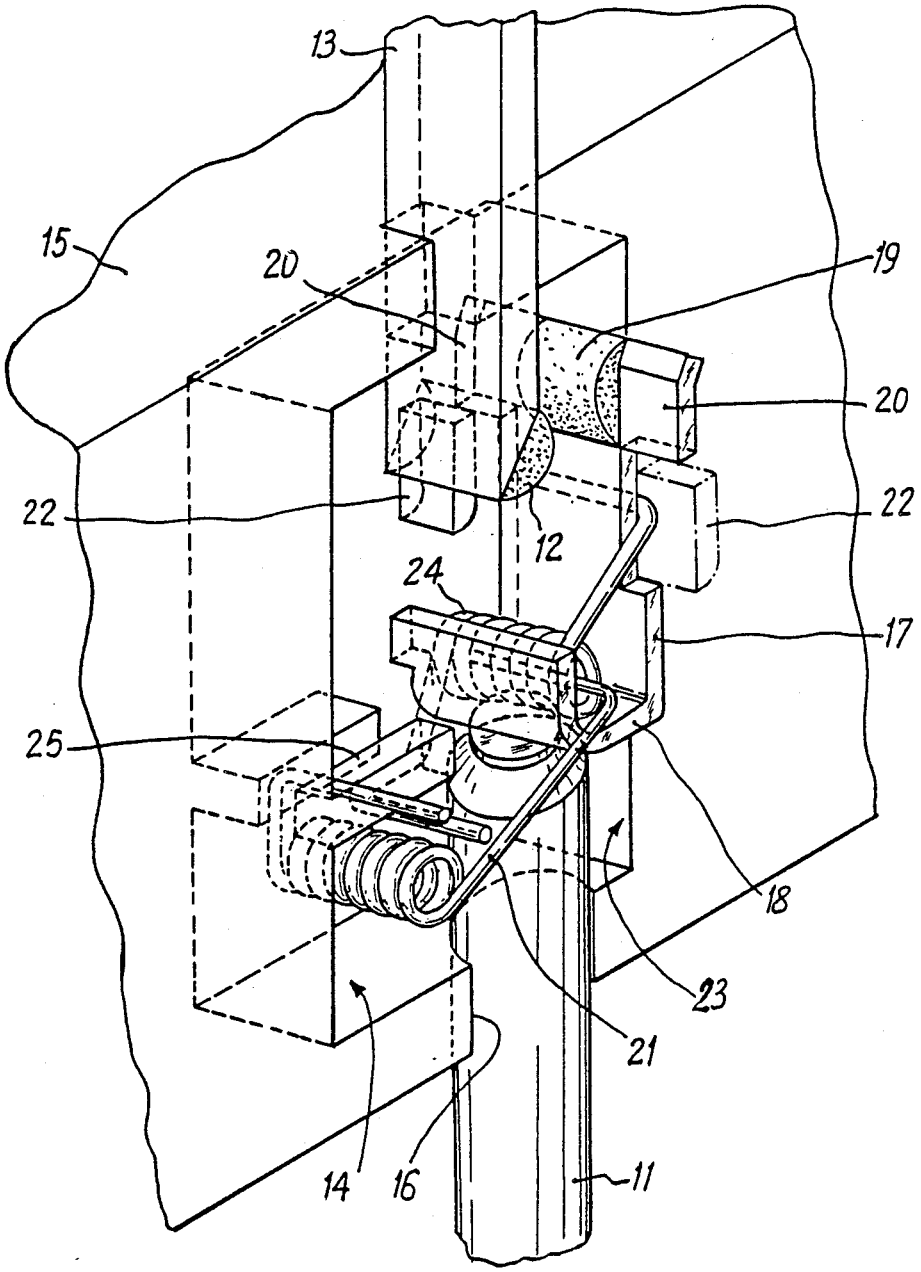
FIG. 1 is a partial sectional view of a contact formed in accordance with the present invention.

In FIGS. 1 and 2A–2F, a first embodiment is shown, wherein an end-pressure contact is illustrated which is designed to establish an electrical connection between conductive connector-pin 11, which is rigidly attached to the insulating support of a plug (not shown), and stationary contact bead 12, which is electrically connected to an input terminal (not shown) by conductive strip 13. Stationary contact bead 12 is placed within chamber 14 formed within insulating support 15 of a plug socket (which is not otherwise illustrated); the chamber is provided with bore 16 to permit the axial introduction of connector-pin 11. The electrical connection between pin 11 and contact bead 12 is achieved by guided longitudinal displacement, which is followed by the tilting motion of rigid conductive member 17. This member is thus placed within chamber 14 and is adapted to extend along at least a portion of the height of chamber 14.

In the example illustrated in in FIGS. 1 and 2A–2F, movable conductive member 17 comprises a small plate, best shown in FIG. 1, one end of which is bent rearwardly twice at 90° in order to form a U-shaped heel 18. The other remote end of the small plate is adapted to carry movable contact bead 19; the bead is designed to cooperate with stationary contact bead 12 and is provided with lateral extensions 20, to provide the member with a T-shaped configuration.

In its rest position (shown in FIG. 2A), i.e., before or after withdrawal of connector-pin 11, movable member 17 is urged toward the exterior of chamber 14, while heel 18 of the member is applied against one end or edge of bore 16 under the action of first torsional coil spring 21. One end arm of the spring is engaged within the U-shaped portion formed by heel 18, while the other end arm is clamped and held in position against the internal wall of chamber 14.

Two guide lugs 22, which are spaced from chamber side wall 23, along which member 17 can be longitudinally displaced, are placed transversely within chamber 14 and are substantially aligned with each other along a plane which is substantially parallel to the side wall. The distance between the opposite edges of the two guide lugs 22 is greater than the width of the central, relatively narrow portion of member 17, but smaller than the width of the T-shaped remote end portion of member 17.

Second torsional coil spring 24 is intended to act on member 17. One end arm of the second spring is applied against that face of the member which is directed toward side wall 23 of the chamber and on the member surface opposite from contact bead 19, the coil spring being placed within the U-shaped portion formed by heel 18. One advantageous feature is that one end arm of spring 21, which is engaged within the U-shaped portion of heel 18, is placed inside the coil of spring 24 and thus serves to maintain the spring in its position.

Figure 2A:
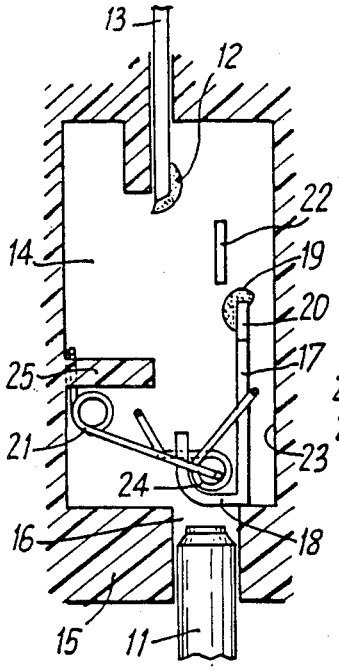
FIGS. 2A–2F represent diagrammatic views, taken along a smaller scale, which illustrate the different stages of operation of the movable member, e.g., at the times of inward displacement and outward withdrawal of the connector-pin, in accordance with the embodiment of FIG. 1.
Figure 2B:
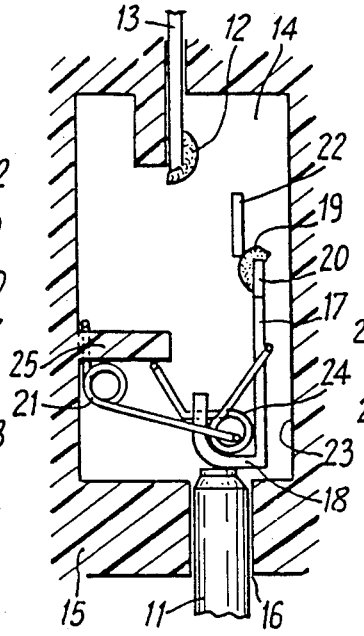

In its rest position (as best illustrated in FIG. 2A), the T-shaped end of member 17, with its contact bead 19, is located at a lower level than guide lugs 22 (assuming that the axis of the contact itself is vertical, as shown in the drawing), and the second end arm of spring 24 is not subject to any stress, i.e., it is freely positioned within chamber 14.

When connector-pin 11 is displaced axially inwardly of bore 16 and of chamber 14, the free end of the pin is applied against heel 18 of member 17. When the inward displacement continues, member 17 is thrust rearwardly in the direction of the end wall (unreferenced) of the chamber. In a first stage of movement (best illustrated in FIG. 2B), lateral extensions 20 of member 17 are engaged between side wall 23 and guide lugs 22. Simultaneously, the free end of spring 24 abuts against at least one internal projection 25 of chamber 14; projection 25 also serves to maintain spring 21 in its position.

As the inward displacement of connector-pin 11 continues, member 17 undergoes a displacement in a direction which is substantially parallel to itself and towards the end wall of the chamber. In this case, lateral extensions 20 are firmly applied against guide lugs 22 under the biasing action of spring 24 (as best shown in FIG. 2C).

Figure 2C:
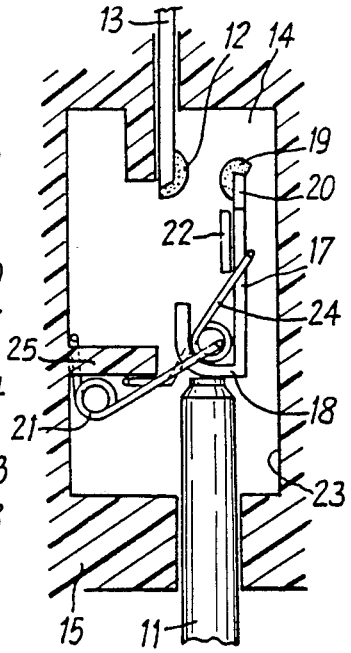
Figure 2D:
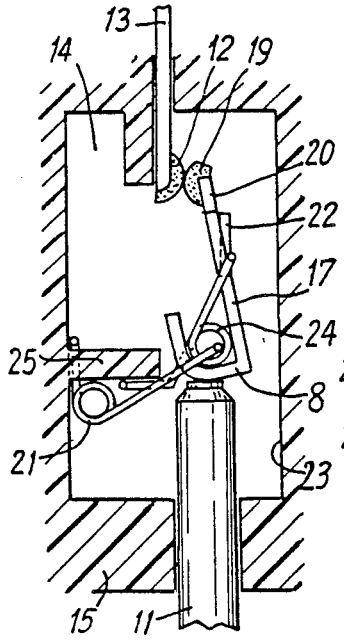

The assembly is arranged so that contact bead 19 of movable member 17 reaches the level of stationary contact bead 12 at the time that lateral extensions 20 pass beyond the top edges of guide lugs 22 (as shown in FIG. 1 and in FIG. 2C). Under the action of spring 24, member 17, which is no longer retained by lugs 22, then tilts forwardly towards the chamber wall which is positioned opposite to side wall 23. At this point, contact bead 19 is abruptly applied in abutting relationship against stationary contact bead 12 (as best shown in FIG. 2D), thus resulting in abrupt closing of the contact.

It is readily apparent that locking action must occur in order to maintain connector-pin 11 in a stationary contact position. This locking action can be obtained by any known means, e.g., a bayonet-type coupling such that the plug which is rigidly fixed to the connector-pin will be locked in position with respect to the plug socket in which chamber 14 is located.

Figure 2E:
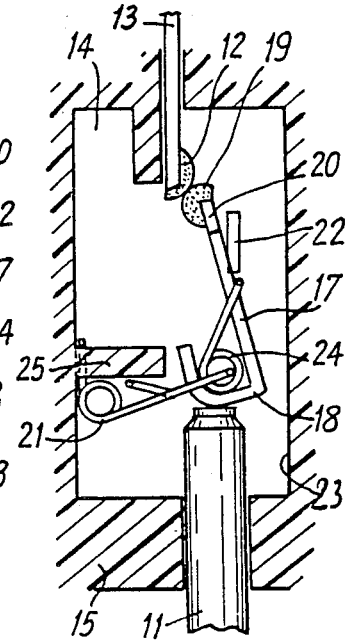

After unlocking, outward withdrawal of plug connector-pin 11 is achieved by simple axial traction. This movement is facilitated, enhanced, and accelerated by the action of spring 21, which tends to drive connector-pin 11 outwardly of the chamber by maintaining heel 18 applied against the top end of the connector-pin. At the beginning of the operation (as best illustrated in FIG. 2E), movable contact bead 19, which is still resiliently biased against stationary contact bead 12 by spring 24, slides over bead 12 in order to achieve self-cleaning of the contact bearing surfaces. As an additional advantageous feature, contact beads 12 and 19 are formed semicylindrically in order to produce a powerful self-cleaning action when they rub against one another.

Figure 2F:
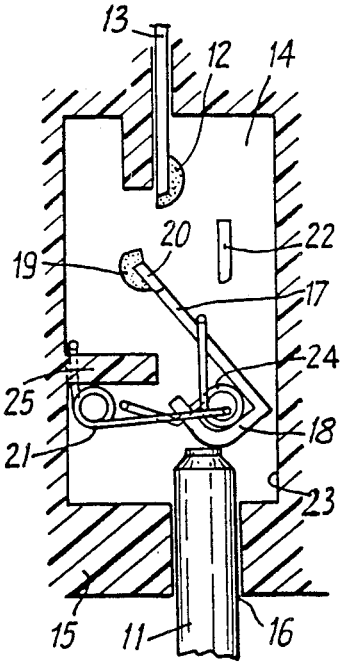

As the outward withdrawal of connector-pin 11 continues, member 17 continues to follow the pin in the direction of chamber bore 16. At a single moment, contact bead 19 moves away from contact bead 12 and, under the action of spring 24, tilts forwardly abruptly toward the wall which is oppositely located from side wall 23 (as seen in FIG. 2F), to thus abruptly open the contact. Simultaneously, the end arm of spring 24 moves away from projection 25; since spring 24 is thus freed from any further stress, member 17 is subjected only to the action of spring 21, which accordingly applies the curved front portion of heel 18 against the top end of connector-pin 11. The point of contact is not level with the end arm of spring 21, and member 17 thus tends to move back to its upright position, this movement being facilitated by the curved design of heel 18. At the end of its travel path, heel 18 of member 17 is applied against the edge of the chamber bore, thus reassuming its rest position (as best shown in FIG. 2A) to prepare itself to again receive the inserted connector-pin 11. It is possible, however, to devise different means for guiding member 17 as it returns to its upright position.

Thus, the contact is a true single-pole switch of the quick make-and-break type.

The foregoing description relates to a single contact employed alone, but it is apparent and obvious that a plurality of contacts of this type permit the construction of different devices, particularly current supply connectors in which each contact (with the possible exception of an existing earth contact) will perform the function of a switch. This arrangement is achieved independently of all known arrangements which may be adopted (angular displacement of at least one contact, insulating supports having variable angular positions, single or double density safety disks, and so on).

FIGS. 3 and 4A–4H illustrate another embodiment of the invention in which an end-pressure contact is illustrated which is designed to establish an electrical connection between conductive connector-pin 111, which is rigidly attached to the insulating support of a plug (not shown), and stationary contact element 112, which is electrically connected to an input terminal (not shown) by conductive pin 113. Stationary contact element 112 can comprise a flat contact plate or stud or a semi-cylindrical contact bead. Stationary contact plate 112 is placed within chamber 114 formed within insulating support 115 of a plug socket (which is not otherwise illustrated). Chamber 114 is provided with bore 116 to permit the axial introduction of connector-pin 111.

In this embodiment, the electrical connection between connector-pin 111 and stationary contact plate 112 is achieved by the movement of conductive member 117. Conductive member 117 moves along a path that is parallel to the longitudinal axis of stationary contact plate 112. The longitudinal axis of stationary contact plate 112 is the axis which is parallel to connector-pin 111 and which passes through the center of stationary contact plate 112. At the same time, conductive member 117 pivots about two axes, the axes being perpendicular to the longitudinal axis of stationary contact plate 112. Conductive member 117 pivots in a clockwise direction while it is retained by end arm 121B of spring 121. In this direction, conductive member 117 pivots about the axis defined by end arm 121B of spring 121 and a second axis defined by end arm 121A of spring 121. At the moment conductive member 117 escapes from end arm 121B of spring 121, it pivots in a counterclockwise direction, making an abrupt contact with stationary contact element 112. In this direction, conductive member 117 pivots about the axis defined by end arm 121A of spring 121. The embodiment can also be built so that conductive member 117 first pivots in a counterclockwise direction and, after escaping end arm 121B, pivots in a clockwise direction, during introduction of connector-pin 111.

The two torsional coil springs 21 and 24 of FIGS. 1 and 2 are combined in this embodiment into single torsional coil spring 121. Spring 121 also operates as the guiding and retaining means for conductive member 117.

Torsional coil spring 121 defines both the kinematics and the dynamics of the displacement of movable member 117, both during the inward displacement of connector-pin 111 into chamber 114, and during the removal of connector-pin 111. In other words, torsional coil spring 121 defines the location of conductive member 117 as it traverses chamber 114 in response to the introduction, as well as the withdrawal, of connector-pin 111. Spring 21 thus defines the orientation of conductive member 117 in any given location within chamber 114 during the introduction and withdrawal of connector-pin 111.

In the example illustrated in FIGS. 3 and 4A–4H, movable conductive member 117 is V-shaped which consists of two arms or branches. The bottom branch, shown as heel 117A, is slightly shorter then the other branch, arm 117B. Heel 117A serves as a support surface for the free end of connector-pin 111. Contact plate 119 is attached to the exterior surface of the free end of arm 117B. Contact plate 119 is designed to cooperate with stationary contact plate 112.

Figure 3:
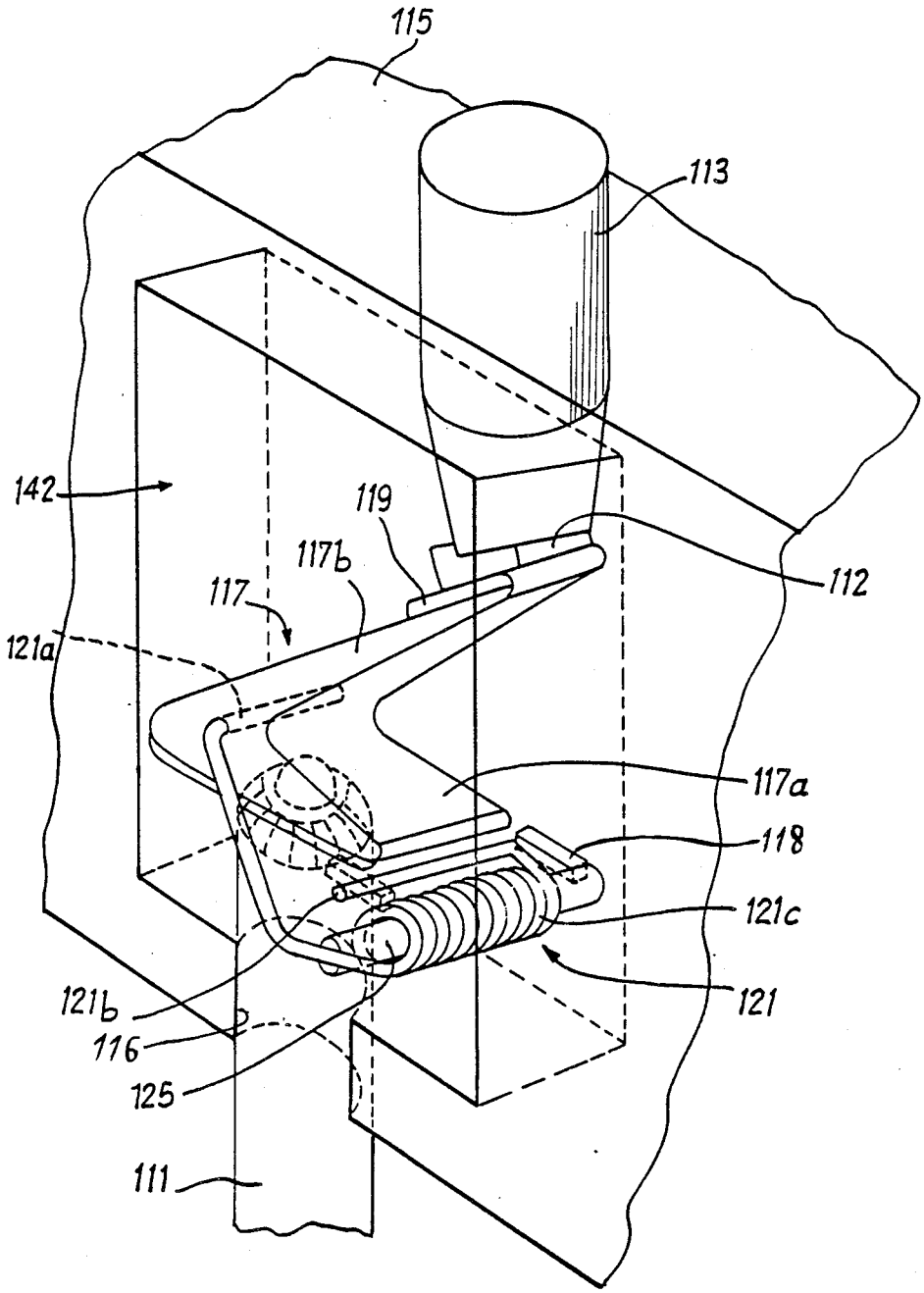
FIG. 3 is a partial sectional view of a contact formed in accordance with another embodiment of the present.

This embodiment includes a single helical torsion spring 121, best shown in FIG. 3. Coil 121C of spring 121 is slipped onto support pin 125, which is integral with one of the walls of chamber 114 and extends to a region of chamber 114 which is in the immediate vicinity of the opposite wall. Two end arms 121A and 121B of spring 121 are bent at right angles towards the middle or center of coil 121C of spring 121, parallel to pin 125 as shown in FIG. 3. End arm 121A, which extends from spring 121 on the side of the free end of pin 125, is attached to conductive member 117 so as to form an axis of rotation. End arm 121A is attached to conductive member 117 where heel 117A and arm 117B meet. End arm 121B, the other end of spring 121, is immobilized by a housing, or abutting against ridge 118, extending inwardly from the wall of chamber 114 which carries support pin 125. Thus, spring 121 cannot turn around pin 125. It is contemplated that any other means of immobilization can also be used.

Stationary contact plate 112, connector-pin 111 and conductive member 117 have as their common plane of symmetry the diametral plane of connector-pin 111 which is perpendicular to pin 125. In other words, these elements all are positioned symmetrically about the plane which is defined by the diameter of connector-pin 111 which is perpendicular to pin 125. The extension of the axis of connector-pin 111 is also spaced in this plane.

Figure 4D:
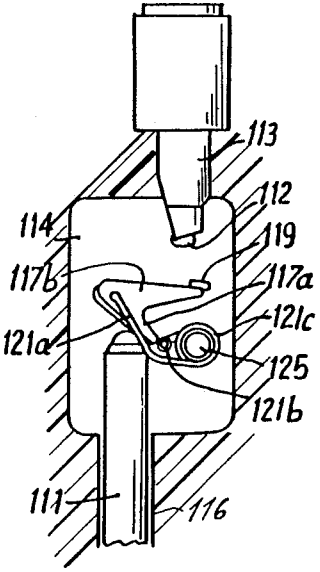
FIGS. 4A–4H represent diagrammatic views, taken along a smaller scale, which illustrate the different stages of operation of the movable conductive member, e.g., at the times of inward displacement and outward withdrawal of the connector-pin, in accordance with the embodiment of FIG. 3.
Figure 4C:
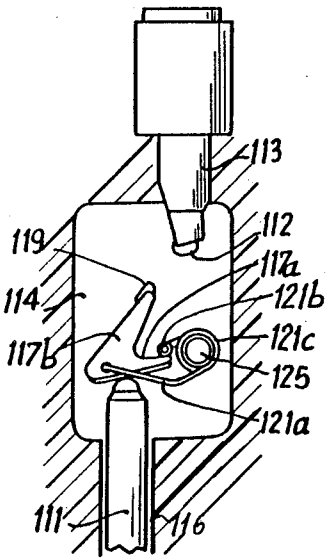
Figure 4B:
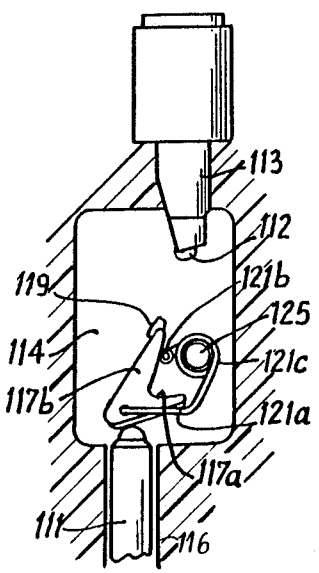
Figure 4A:
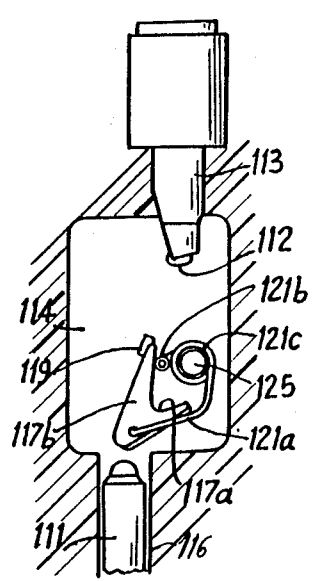

The operation of this embodiment is as follows. When connector-pin 111 is displaced axially inwardly of bore 116 of chamber 114 (as shown in FIG. 4A), it presses against the exterior surface of heel 117A of conductive member 117 (FIG. 4B). Conductive member 117 moves along a path that is parallel to the longitudinal axis of stationary contact plate 112 and simultaneously pivots around the axis defined by end arm 121B of spring 121 and a second axis defined by end arm 121A of spring 121. The interior surface of conductive member 117 presses against end arm 121B of spring 121.

As the inward displacement of connector-pin 111 continues, conductive member 117 longitudinally traverses chamber 114. The free end of connector-pin 111 slides along the length of the exterior surface of heel 117A under the biasing action of spring 121. The interior surface of heel 117A is thus pushed into position abutting against end arm 121B of spring 121 (FIG. 4C). Thus conductive member 117 pivots around the axes defined by end arm 121B and around end arm 121A of spring 121 in a clockwise direction.

Figure 4H:
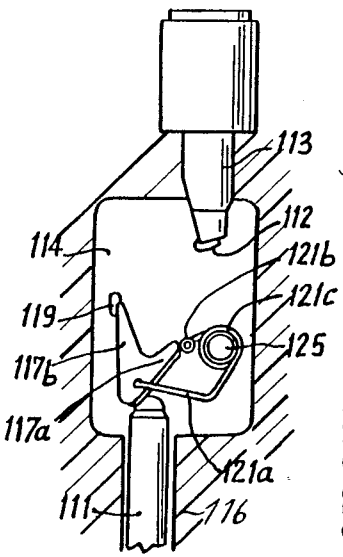
Figure 4G:
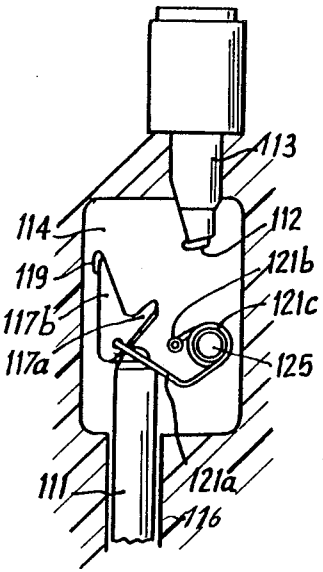

Spring 121 accumulates energy by torsion when the inward displacement of connector-pin 111 continues (FIG. 4D) until the pivoting of conductive member 117 is sufficient to cause heel 117A to escape the retention of end arm 121B of spring 121. Spring 121 then suddenly transfers a portion of its accumulated energy, by causing conductive member 117 to pivot about the end arm 121A in the counterclockwise direction. This causes contact plate 119 to be abruptly applied in an abutting relationship against stationary contact plate 112 (FIG. 4E). In this manner, the circuit is abruptly closed and the electrical connection is achieved.

At the moment of contact between contact plate 119 and stationary contact plate 112, connector-pin 111 is locked into position with respect to the plug socket in which chamber 114 is located. This locking action can be obtained by any known means, e.g., a bayonet-type coupling such that the plug which is rigidly fixed to the connector-pin will be locked in position with respect to the plug socket in which chamber 114 is located.

After unlocking, the outward withdrawal of connector-pin 111 and its return to its initial position is achieved as follows. Spring 121, which is always under pressure, continues to constantly press heel 117A of member 117 against the end of the connector-pin 111. Thus, conductive member 117 pivots about end arm 121A of spring 121 while continuing to press against the end of connector-pin 111.

Figure 4F:
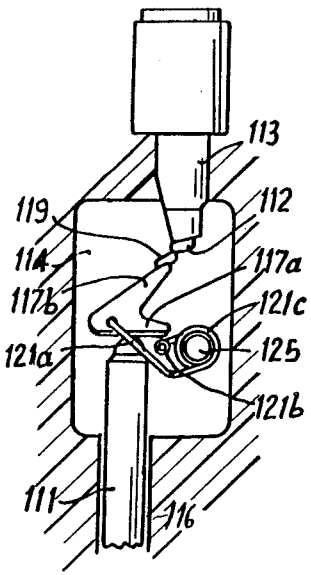
Figure 4E:
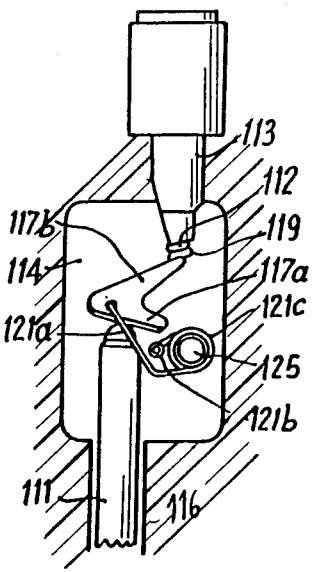

At the beginning of the operation (as best illustrated in FIG. 4F), contact plate 119, which is still resiliently biased against stationary contact plate 112 by spring 121, slides over stationary contact plate 112 thus achieving self-cleaning of the contact bearing surfaces. This sliding action continues until contact plate 119 escapes stationary contact plate 112, thus causing a sudden movement of conductive member 117 under the biasing action of spring 121 and the resulting abrupt opening of the contact (FIG. 4G). until the time of the escape during withdrawal, conductive member 117 is pivots about the axis defined by end arm 121A of spring 121 in a counterclockwise direction. The movement continues as the end of heel 117A passes under bent end arm 121B of spring 121 (FIG. 4H). Once conductive member 117 passes under arm 121B, it pivots about the axes defined by end arm 121A and end arm 121B of spring 121 in a clockwise direction until conductive member 117 returns to the initial position (FIG. 4A).

An advantageous feature of this embodiment is that when contact plates 112 and 119 are slid against one another upon removal of connector-pin 111, a self-cleaning operation of the contact bearing surfaces occurs. This is useful in order to maintain the high quality of the contact. The spacing of the axes of stationary contact plate 112, connector-pin 111, and conductive member 117 with its contact plate 119, in the common plane of symmetry for connector-pin 111, encourages this sliding and increase its amplitude. The axis of conductive member 117 which is in the plane of symmetry of connector-pin 111 is that axis which is parallel to connector-pin 111 and which passes through the center of movable contact plate 119. Contact plates 112 and 119 can have semi-cylindrical shapes to increase the sliding. Alternatively, they can have flat, thin shapes.

The preferred embodiment of FIGS. 3 and 4A–4H, disclosed includes a V-shaped conductive member 117. The scope of the invention includes any variation in the shape of conductive member 117 which can function in the same manner as disclosed above.

Although the present invention has been described with respect to specific features, embodiments, and advantages thereof, it is clear that a variety of such embodiments, features, and advantages are contemplated as within the scope of the present invention.

What is claimed is:

1. A pressure contact for establishing an electrical connection between a movable conductive connector-pin rigidly attached to a support and a stationary contact element electrically connected to an input terminal and located within a plug socket chamber when said connector-pin is axially introduced into said plug socket chamber, said support and said plug socket chamber including means for guiding said connector-pin into said plug socket chamber, said pressure contact comprising:

(a) a rigid and movable conductive member for location within said plug socket chamber which pivots about at least one axis in response to continued axial movement of a free end of said connector-pin, said conductive member being adapted to contact said stationary contact element, said conductive member including a heel having an exterior surface which is in contact with said free end of said connector-pin as it moves longitudinally through said chamber, said conductive member further comprising a contact element mounted thereon;

(b) means for guiding said conductive member as it moves through said chamber until said conductive member is released causing said contact element mounted on said conductive member to establish substantially instantaneous contact with said stationary contact element; and (c) resilient means for biasing said heel against the free end of said connector-pin as said connector-pin is introduced into said chamber.

2. A pressure contact in accordance with claim 1, further comprising retaining means for retaining said conductive member as said conductive member is guided through said chamber.

3. A pressure contact in accordance with claim 2, wherein said conductive member pivots in response to the introduction of said connector-pin into said chamber in a clockwise direction about said at least one axis prior to escape of said conductive member from said retaining means.

4. A pressure contact in accordance with claim 3, wherein said conductive member pivots in response to the introduction of said connector-pin into said chamber in a counterclockwise direction about said at least one axis after escape of said conductive member from said retaining means and prior to the sudden contact of said stationary contact element and said contact element mounted on said conductive member.

5. A pressure contact in accordance with claim 4, wherein said conductive member pivots in response to the withdrawal of said connector-pin from said chamber in a counterclockwise direction about said at least one axis before said conductive member passes under said retaining means.

6. A pressure contact in accordance with claim 5, wherein said conductive member pivots in response to the withdrawal of said connector-pin from said chamber in a clockwise direction about said at least one axis after said conductive member passes under said retaining means.

7. A pressure contact for establishing an electrical connection comprising:

(a) a stationary contact element electrically connected to an input terminal and located within a plug socket chamber;

(b) a movable conductive connector-pin rigidly attached to a support adapted to be introduced into a bore in said plug socket chamber; and (c) an intermediate pivotable conductive member positioned between said stationary contact element and said bore and adapted to contact said stationary contact element, wherein said conductive member moves along a path parallel to the longitudinal axis of said stationary contact element, in response to the introduction of said connector-pin into said bore, and simultaneously pivots about at least one axis that is perpendicular to said axis of said stationary contact element such that when said intermediate pivotable conductive member is released and contacts said stationary contact element, an electrical connection is substantially instantaneously established between said stationary contact element and said conductive member.

8. A pressure contact in accordance with claim 7, further comprising resilient means for biasing said conductive member towards said bore in opposition to the longitudinal motion of said conductive member induced by the introduction of said connector-pin.

9. A pressure contact in accordance with claim 8, wherein said resilient means comprises means for allowing different locations of said conductive member, and different orientations of said conductive member within said different locations, when said connector-pin is introduced and withdrawn from said chamber.

10. A pressure contact for establishing an electrical connection between a movable conductive connector-pin rigidly attached to a support and a stationary contact element electrically connected to an input terminal and located within a plug socket chamber when said connector-pin is axially introduced into said plug socket chamber, said support and said plug socket chamber including means for guiding said connector-pin into said plug socket chamber, said pressure contact comprising:

(a) a rigid and movable conductive member located within said plug socket chamber, said conductive member being adapted to contact said stationary contact element, said conductive member pivoted about at least one axis in response to continued axial movement of a free end of said connector-pin;

(b) means for retaining said conductive member;

(c) means for guiding said conductive member pivotally about at least one axis until said conductive member escapes from said retaining means, wherein when said conductive member escapes said retaining means, said conductive member establishes substantially instantaneous contact with said stationary contact element; and (d) single resilient means for biasing said conductive member against the free end of said connector-pin as said connector-pin is introduced into said chamber.

11. A pressure contact in accordance with claim 10 wherein said single resilient means comprising means for allowing different locations of said conductive member, and different orientations of said conductive member within said different locations, when said connector-pin is introduced and withdrawn from said chamber.

12. A pressure contact in accordance with claim 11 wherein said movable conductive member has a generally V-shape and wherein one branch of said V-shaped member comprises a heel, having an exterior surface which is adapted to be contacted by said free end of said connector-pin when said connector-pin moves longitudinally through said chamber, and another branch of said V-shaped member comprises an arm having an exterior surface, said exterior surface of said arm having a contact element attached thereto, adapted to cooperate with said stationary contact element when said conductive member establishes substantially instantaneous contact with said stationary contact element.

13. A pressure contact in accordance with claim 12 wherein said single resilient means comprises a torsional coil spring, said spring having a coil portion rotatably mounted about a support pin, said support pin having one end which is integral with a wall of said chamber and a free end which extends into a region of said chamber in an immediate vicinity of an opposite wall of said chamber.

14. A pressure contact in accordance with claim 13 wherein said spring comprises a first end arm and a second end arm, said first and second end arms being bent at right angles towards a middle portion of said coil portion, parallel to said support pin, and wherein said first end arm comprises said guiding means and said second end arm comprises said retaining means.

15. A pressure contact in accordance with claim 14 wherein said first end arm is on a side of said coil portion which corresponds to said free end of said support pin and wherein said first end arm is attached to said conductive member to form an axis of rotation.

16. A pressure contact in accordance with claim 15 wherein said second end arm is on another side of said coil portion, and wherein said second end arm abuts against a ridge extending inwardly from said wall of said chamber.

17. A pressure contact in accordance with claim 16 wherein said stationary contact element and said movable contact element are both flat, and thus comprise means for self-cleaning one another when said elements are rubbed against each other.

18. A pressure contact in accordance with claim 17 wherein said stationary contact element, said connector-pin and said conductive member have a common plane of symmetry and wherein said stationary contact element and said connector-pin have an axis which is spaced in said common plane of symmetry to increase effectiveness of said means for self-cleaning.

19. A pressure contact in accordance with claim 11 wherein said conductive member pivots about at least one axis, in response to the introduction of said connector-pin into said chamber and continued axial movement of said connector-pin through said chamber, in a clockwise direction until said conductive member escapes said retaining means and about said at least one axis in a counterclockwise direction after said conductive member escapes said retaining means.

20. A pressure contact in accordance with claim 19 wherein said conductive member pivots in response to the withdrawal of said connector-pin from said chamber about said at least one axis in said counterclockwise direction before said conductive member engages with said retaining means and about said at least one axis in said clockwise direction after said conductive member engages with said retaining means.

21. A connector for placing a plug and a socket into electrical engagement, said plug having a connector-pin and said socket having a chamber, said connector comprising:

(a) a movable conductive member having a generally V-shape, including a first branch which comprises a heel which has an exterior surface which is in contact with a free end of said connector-pin as said connector-pin moves longitudinally through said chamber, said conductive member including a second branch which comprises an arm having an exterior surface, said exterior surface of said arm having a contact element attached thereto, said conductive member being positioned within said chamber; wherein said conductive member pivots in at least one direction about at least one axis in response to the introduction of said connector-pin into said chamber and pivots in at least one direction about said at least one axis in response to withdrawal of said connector-pin from said chamber; and (b) a spring connected to said movable conductive member for biasing said movable conductive member against said connector-pin and for guiding movement of said conductive member as it pivots and moves longitudinally within the chamber, said spring comprising a coil portion rotatably mounted about a support pin integrally connected to a wall of said chamber, a first arm attached to said conductive member to form an axis of rotation, and a second arm positioned in abutting relationship with a projection extending inwardly from said wall of said chamber.

22. A connector in accordance with claim 21 wherein said chamber includes a bore into which said connector-pin is inserted, wherein the free end of said connector-pin contacts said heel when said connector-pin is inserted.

23. A connector in accordance with claim 21 wherein a conductive pin extends into said chamber at an end opposite from an end of said chamber into which said connector-pin is to be inserted, said conductive pin having a stationary contact element located at an end of said conductive pin.

* * * * *

UNITED STATES PATENT AND TRADEMARK OFFICE

CERTIFICATE OF CORRECTION

PATENT NO. : 4,632,481

DATED : Dec. 30, 1986

INVENTOR(S) : Yves Le Magourou

It is certified that error appears in the above-identified patent and that said Letters Patent is hereby corrected as shown below:

The term of this patent subsequent to May 14, 2002, has been disclaimed.

Signed and Sealed this

Twenty-seventh Day of December, 1988

*Attest:*

DONALD J. QUIGG

*Attesting Officer*

*Commissioner of Patents and Trademarks*